US010935932B2

(12) United States Patent
Mace et al.

(10) Patent No.: US 10,935,932 B2
(45) Date of Patent: Mar. 2, 2021

(54) DEVICE FOR REWINDING AND/OR IMMOBILIZING A MARINE CHRONOMETER

(71) Applicant: Montres Breguet S.A., L'Abbaye (CH)

(72) Inventors: Jerome Mace, Le Pont (CH); Alain Zaugg, Le Sentier (CH)

(73) Assignee: Montres Breguet S.A., L'Abbaye (CH)

( * ) Notice: Subject to any disclaimer, the term of this patent is extended or adjusted under 35 U.S.C. 154(b) by 333 days.

(21) Appl. No.: 16/104,246

(22) Filed: Aug. 17, 2018

(65) Prior Publication Data

US 2019/0094805 A1 Mar. 28, 2019

(30) Foreign Application Priority Data

Sep. 22, 2017 (EP) ..... 17192681

(51) Int. Cl.

| | |
|---|---|
| ***G04B 3/00*** | (2006.01) |
| ***G04B 37/14*** | (2006.01) |
| ***G04B 37/10*** | (2006.01) |
| ***G04B 41/00*** | (2006.01) |
| ***G04B 3/04*** | (2006.01) |
| ***G04B 3/08*** | (2006.01) |

(52) U.S. Cl.

CPC ..... *G04B 3/006* (2013.01); *G04B 3/00* (2013.01); *G04B 3/04* (2013.01); *G04B 3/08* (2013.01); *G04B 37/10* (2013.01); *G04B 37/14* (2013.01); *G04B 37/1426* (2013.01); *G04B 41/00* (2013.01)

(58) Field of Classification Search

CPC . G04B 3/006; G04B 3/00; G04B 3/04; G04B 3/08; G04B 37/10; G04B 37/14; G04B 37/1426; G04B 41/00; G04B 37/068; G04B 37/142; G04B 3/02; G01C 17/00

USPC ..... 368/147

See application file for complete search history.

(56) References Cited

U.S. PATENT DOCUMENTS

| | | | |
|---|---|---|---|
| 227,972 | A | 5/1880 | Gareis |
| 2,419,768 | A | 4/1947 | Ensign et al. |
| 2,425,602 | A | 8/1947 | Drescher |

(Continued)

FOREIGN PATENT DOCUMENTS

| | | |
|---|---|---|
| CH | 2 960 | 4/1891 |
| CH | 89 275 | 5/1921 |

(Continued)

OTHER PUBLICATIONS

European Search Report dated Mar. 23, 2018 in European application 17192681.9, filed on Sep. 22, 2017 (with Translation of Categories Cited and Written Opinion).

*Primary Examiner* — Edwin A. Leon

(74) *Attorney, Agent, or Firm* — Oblon, McClelland, Maier & Neustadt, L.L.P.

(57) ABSTRACT

A marine chronometer includes a clock mounted on a support, for example mounted so that it can be inclined with respect to the support using a gimbal mounting, the clock including, inside a case, a mechanical clock movement driven by a barrel, and the clock also including a rewinding control member engaged with a rewinding geartrain for rewinding the barrel. The rewinding control member includes a rewinding control geartrain positioned on the outside of the clock, secured to a spindle passing through a wall of the case via a bearing, the through-spindle being engaged with the rewinding geartrain.

10 Claims, 3 Drawing Sheets

(56) References Cited

U.S. PATENT DOCUMENTS

| | | | | |
|---|---|---|---|---|
| 3,191,901 | A * | 6/1965 | Green | G04B 37/1426<br>248/116 |
| 10,401,797 | B2 * | 9/2019 | Mace | G04B 41/00 |

FOREIGN PATENT DOCUMENTS

| | | |
|---|---|---|
| FR | 1 085 226 | 1/1955 |
| FR | 1 198 657 | 12/1959 |

* cited by examiner

DEVICE FOR REWINDING AND/OR IMMOBILIZING A MARINE CHRONOMETER

This application claims priority from European Patent Application No. 17192681.9 filed on Sep. 22, 2017, the entire disclosure of which is hereby incorporated herein by reference.

TECHNICAL FIELD AND PRIOR ART

The invention relates to a mechanical marine chronometer comprising a clock generally of large format intended to keep time on boats. In a known way, such a clock comprises, inside a case, a mechanical movement driven by a barrel and such a clock is fixed to a support by means of a gimbal mounting so that the clock can be inclined in all directions with respect to the support. The gimbal mounting thus makes sure that the clock and, more particularly, the clock's oscillator, remains in a horizontal position regardless of the movements of the boat. However, a gimbal mounting is nevertheless weak and not very well able to withstand movements, knocks, particularly as a result of the weight of the clock it is bearing. Also, a marine chronometer needs to be able to be used in difficult weather conditions and must in particular be water resistant. Thus, as is known, the clock is equipped with a watertight case. However, rewinding the chronometer barrel requires manual interventions from outside the clock case.

Patent Publication D1=CH2960 describes a case for a marine chronometer with a mechanical rewinding mechanism. Fixed to the fuse spindle is a ratchet-tooth pinion F. Mounted on the continuation of this spindle, in the bottom of the case, is a rewinding pinion F' of similar tooth pattern mounted with the ability to slide in order to engage with the pinion F in the rewinding position. Outside the case, a gearwheel D is mounted on the rewinding pinion spindle F', said gearwheel being coupled to a bevel gear pinion C fixed to one end of a rewinding stem. (The references here are those of FIG. 1 of D1). The sealing of the region in which the spindle bearing the rewinding pinion passes through the case of the clock is generally afforded by a seal; however, this sealing is not guaranteed for all conditions of use regardless. In particular, when setting the time or rewinding, the effectiveness of the seal is reduced during the translational movement of the spindle bearing the rewinding pinion F'. What is more, a rewinding system like the one described in D1 is somewhat unreliable because of the potential for slippage between the gearwheel D and the bevel drive wheel C.

DESCRIPTION OF THE INVENTION

The present patent application proposes a novel marine chronometer that does not have at least one of the disadvantages of the known marine chronometers as set out hereinabove.

More specifically, the present invention proposes a marine chronometer comprising a clock mounted on a support, for example mounted so that it can be inclined with respect to the support by means of a gimbal mounting, the clock comprising, inside a case, a mechanical movement driven by a barrel; the clock also comprises a rewinding control member engaged with a rewinding geartrain for rewinding the barrel.

The chronometer according to the invention is wherein the rewinding control member comprises a rewinding control geartrain positioned on the outside of the clock, secured to a spindle passing through a wall of the case via a bearing, the said through-spindle being engaged with the barrel rewinding geartrain.

The bearing allows the rewinding control member to be rotated, notably in order to rewind the barrel, but prevents any translational movement of the spindle passing through the wall of the clock case. The sealing conditions of the bearing thus remain the same, whether the rewinding means is in the rest position or the rewinding position. Furthermore, because the rewinding control geartrain is positioned outside the case, it can be coupled to a rewinding means without any interventions inside the case; thus keeping control of sealing.

The bearing may comprise, on an interior wall, at least one groove in which there is housed a seal that improves the sealing of the case. The seal is, for example, an O ring. During rewinding, the seal is subjected to only radial loadings caused by the rotations of the spindle passing through the rewinding control member, but not to lateral loadings which means that the seal cannot be displaced or deformed. The sealing of the case is thus perfectly maintained even when the barrel is being rewound.

The chronometer according to the invention may also comprise a coupling means comprising a coupling geartrain able to move between a coupling position in which the clock rewinding control geartrain and the coupling geartrain are mechanically coupled and a rest position in which the clock rewinding control geartrain is independent of the coupling means. Produced in this way, the coupling means makes it possible to not move the rewinding control member associated with the barrel translationally for example when rewinding the barrel.

According to one embodiment, the coupling means also comprises a retaining spindle and a lifting mechanism for sliding the coupling geartrain along the retaining spindle between the coupling position and the rest position. The lifting mechanism may for example be of the scissors type and may for example be actuated manually using a lever.

For preference, the rewinding control member and the coupling means are positioned under the clock case in such a way that, when the coupling geartrain is in the coupling position, the clock is resting on the coupling means. Thus, in the coupling position, the coupling geartrain and its retaining spindle support the weight of the clock. If, in addition, the clock is mounted with the ability to move, for example such that it can be inclined on a gimbal mounting, the clock is immobilized resting against the drive member. The clock is therefore locked in position concentric to the central axis of the case, which locked position prevents any disordered movements of the clock during transportation, outside of its timekeeping function on a boat.

The chronometer may also comprise a rewinding means comprising a mechanism for driving the rotation of the coupling geartrain, so as to allow a user to rewind the barrel.

To complement this, the rewinding means may comprise a release mechanism designed to isolate the coupling means from a rotational-drive mechanism when the barrel has reached a rewound position. This makes it possible to avoid breaking the clock and/or the rewinding means should the user apply excessive force.

BRIEF DESCRIPTION OF THE FIGURES

The invention will be better understood, and further features and advantages of the invention will become more apparent in the light of the following description of exemplary embodiments of a chronometer according to the invention. These examples are given nonlimitingly. The description is to be read in conjunction with the attached drawings in which.

DESCRIPTION OF ONE EMBODIMENT OF THE INVENTION

Figure 1:
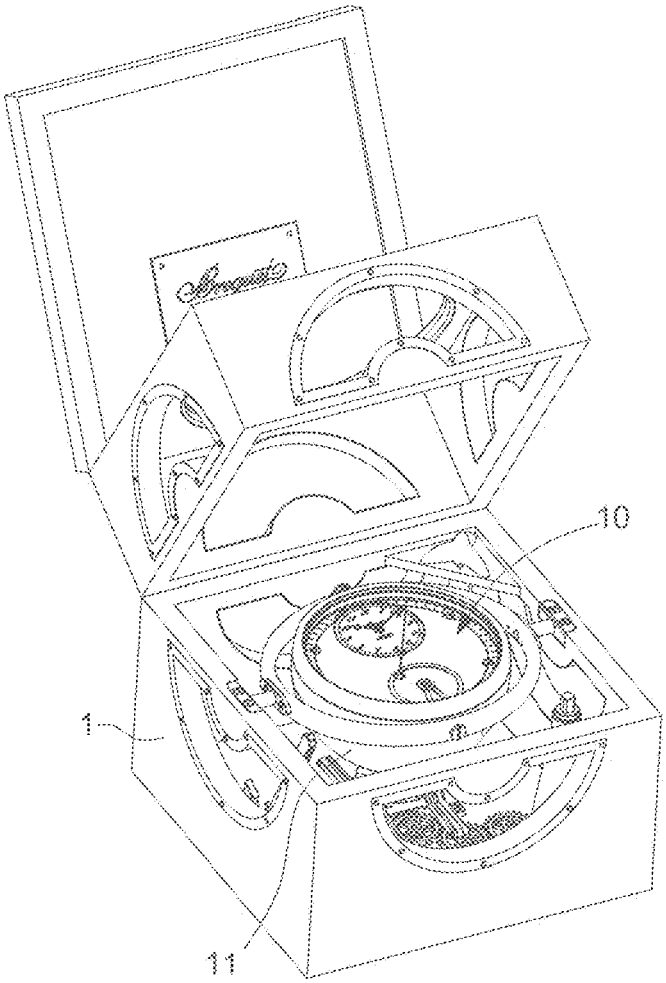
FIG. 1 is a perspective view of the chronometer.

As stated previously, the invention relates to a marine chronometer comprising a clock 10 mounted on a support 30. In FIG. 1, the clock is mounted such that it can be inclined with respect to the support by means of a gimbal mounting and is installed in a casing 1. In the example depicted, the clock 10 comprises a case 11 in the form of a portion of a sphere, inside which case there is housed a conventional mechanical clock movement of the clock of which the drive means, which are known, are formed by a barrel B in mesh with a rewinding geartrain Ba. The case 11 is sealed closed in the conventional way by a crystal under which are positioned a dial and hands (FIG. 1) as well as the clock movement. The gimbal mounting of the clock 10, which are also known per se, are depicted simply in the form of a mounting ring 12; the mechanical connections between the ring 12 and the support 30 are not detailed, in order to keep the figures clear.

The clock according to the invention also comprises a rewinding control member 13 comprising a rewinding control geartrain 14 positioned outside the clock. According to the embodiment depicted, the rewinding control geartrain 14 comprises a flange 14*a* and a plurality of teeth 14*b* cut into an underside face of the flange 14 of the rewinding control geartrain. The geartrain 14 is secured to a spindle 15 passing through a wall of the case 11 via a bearing 11*a*, and the through-spindle 15 is in mesh with the rewinding geartrain (Ba) of the barrel. In the example depicted, the bearing 11*a* comprises, on an interior wall, two grooves in which two 0 ring seals 11*b* are housed to complete the sealing of the case 11 at the spindle 15.

The chronometer according to the invention also comprises a coupling means 20 comprising a coupling geartrain 21 able to move between:

- a coupling position in which the rewinding control geartrain 14 of the clock and the coupling geartrain are mechanically coupled and
- a rest position in which the rewinding control geartrain 14 is independent of the rewinding means.

According to the embodiment depicted, the coupling geartrain 21 comprises a flange 21*a* and a plurality of teeth 21*b* cut into a top face of the flange 21*a* of the coupling geartrain 21 and arranged in such a way that the coupling geartrain 21 can rotationally drive the rewinding control geartrain 14 (mechanical claw coupling) when the coupling geartrain is the rewinding position. The coupling means 20 also comprises a retaining spindle 22 and a lifting mechanism 30 in order to slide the coupling geartrain 21 along the retaining spindle 22 between the coupling position and the rest position.

In the example depicted, the rewinding control member 13 and the coupling means 20 are positioned underneath the clock case so that when the coupling geartrain is in the coupling position, the clock rests on the drive member 20.

Figure 2:
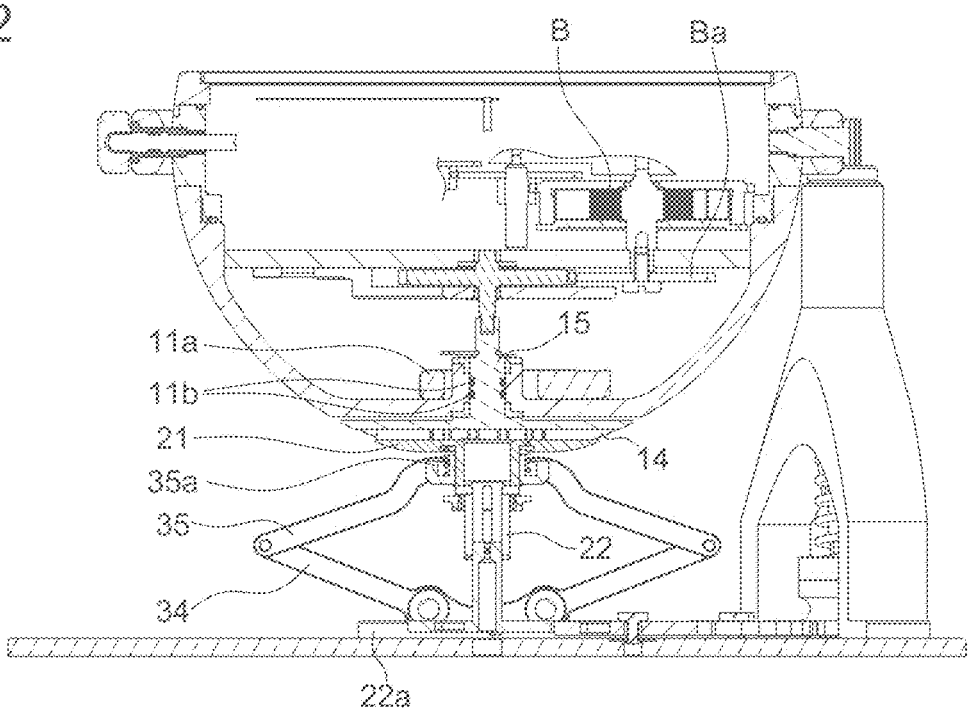
FIG. 2 is a view in section of the essential elements of a chronometer according to the invention, with the rewinding means in the rewinding position and the casing removed.
Figure 3:
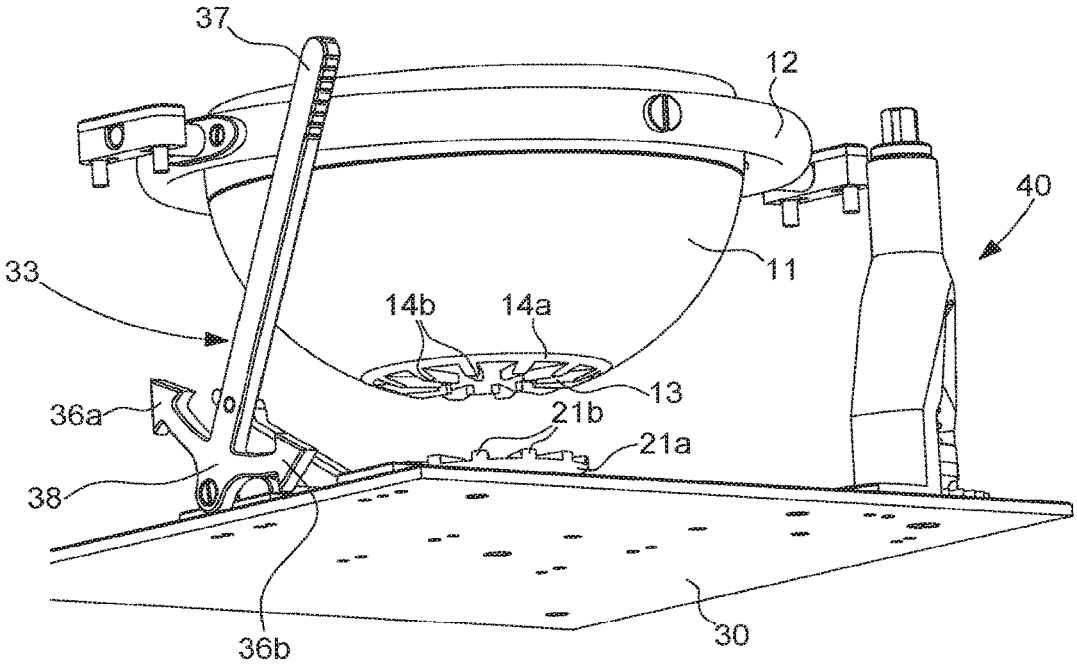
FIGS. 3-5 are perspective or sectional views of the essential elements of a chronometer according to the invention, with the coupling means in the rest position and the casing removed.
Figure 4:
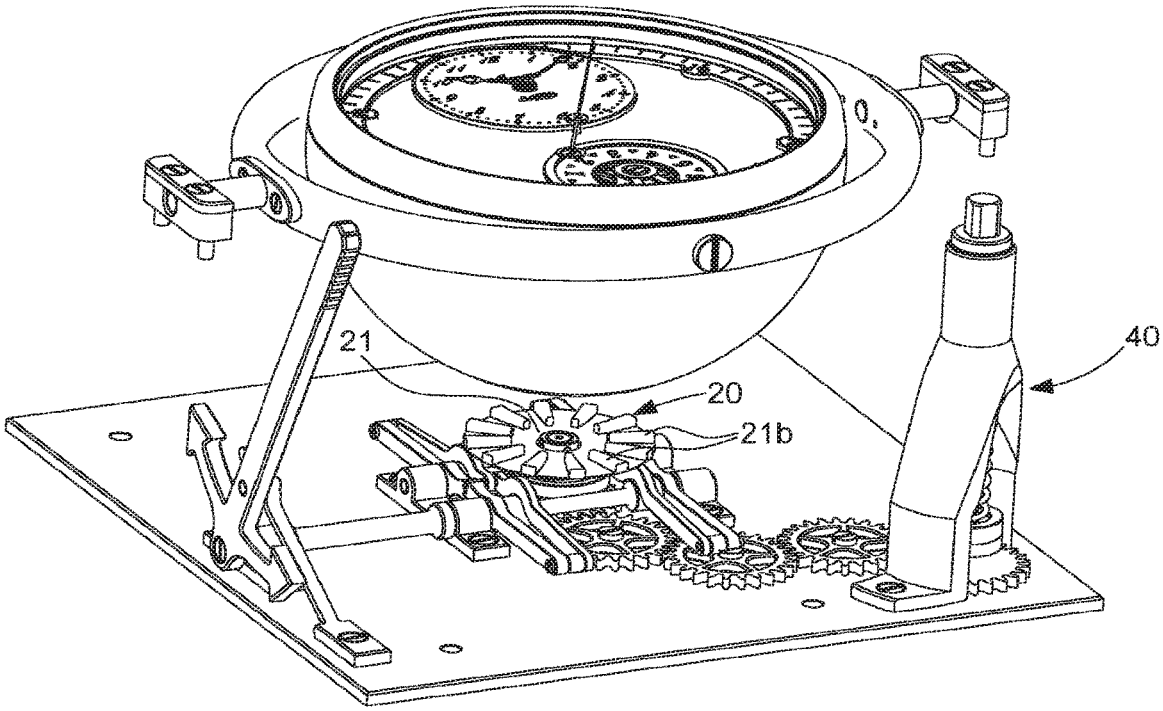

In the example depicted, the lifting mechanism 30 is of the scissors type (FIGS. 3-4), capable of being moved manually by a user using a lever 33. The mechanism 30 here comprises four pairs of links (FIGS. 2-4). Each pair of links comprises two links 34, 35 combined in a scissors arrangement and the pairs of links are connected in pairs. One link 34 comprises a foot end articulated by a pivot connection to the support 30 and a head end articulated by a pivot connection to a head end of an associated link 35; the said associated link 35 also comprises a foot end articulated mechanically by a pivot connection 35*a* to the connecting tube 21*a* of the cradle and to a foot end of another link 35 of a pair of associated links. The lever 33 for its part in the example depicted has two sides and a substantially T-shape; a free end of a long side of the lever forms a handle 37; the two ends 36*a*, 36*b* of the short side 38 form end stops and are a decorative element; one end stop 36*a* for the rest position and the other end stop 36*b* for the retaining and/or rewinding position. At rest, each pair of links 34, 35 forms a closed scissors (FIGS. 3-4). Pulling/turning the handle 37 of the lever causes the pairs of links to open up simultaneously, driving the geartrain 21 translationally in the direction of the retaining spindle 22 into the retaining position; the rewinding control member 13 then presses against the drive member 20 comprising the geartrain 21 and the clock therefore no longer merely rests on the gimbal mounting and is thus immobilized.

Figure 5:
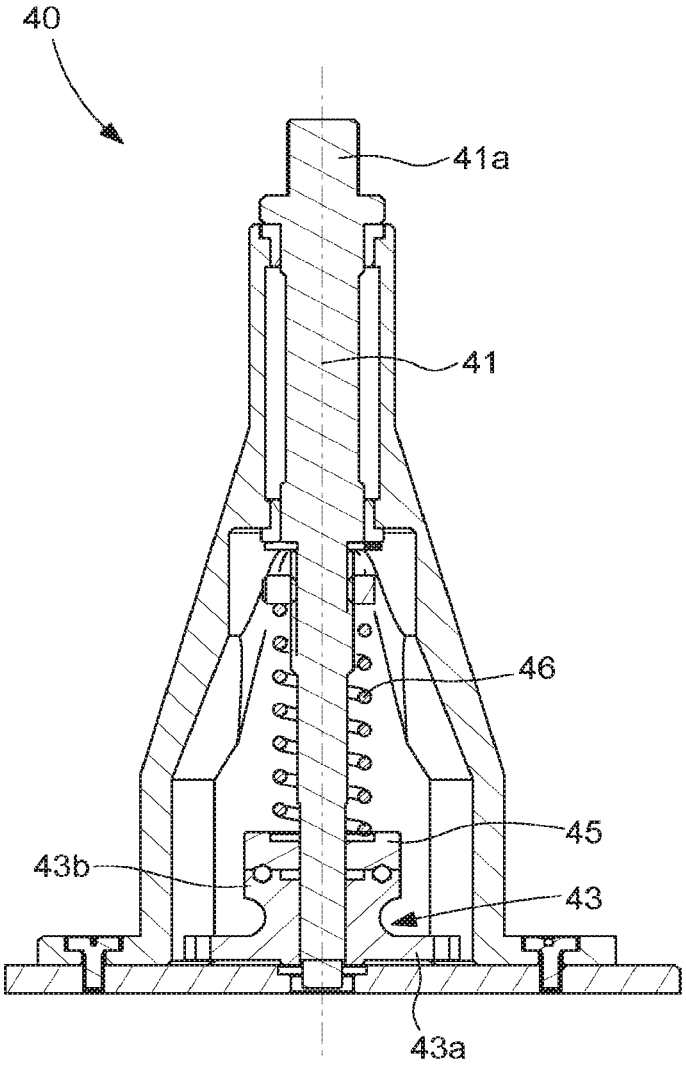

In the figures, the coupling means 20 comprises a connecting geartrain 22*a*; the rewinding means for its part comprises a mechanism for rotationally driving the coupling means 20 and a disengagement mechanism designed to isolate the coupling means 20 from the rotational-drive mechanism when the barrel has reached a rewound position. The rotational mechanism 40 depicted in FIG. 5 comprises:

- a motion-application spindle 41, of which a free end 41*a* is designed to accept a manual-drive device such as a key, a crank, a knob, . . . or an electrically assisted drive device,
- a drive member 43 comprising a geartrain 43*a* in mesh with the connecting geartrain 22*a* and a claw-coupling pinion 43*b*, the said drive member 43 being mounted with the ability to rotate on the motion-application spindle 41,
- a disengagement pinion 45 to complement the claw-coupling pinion 43*a* and kept in mesh with the claw-coupling pinion 43*b* by an elastic return means 46; the claw-coupling pinion 43*b*, the disengagement pinion 45 and the elastic return means 46 together form the disengagement mechanism for disengaging the rewinding means.

The means for rewinding the chronometer according to the embodiment depicted in the figures is used as follows. In the rest position (FIGS. 3-4), the drive member 20 rests on the support 30 and is distant from the clock; the rewinding control member 13 of the clock and the drive member 20 are distant from one another such that there is no mechanical coupling between them; the clock is thus free to move on the gimbal mounting.

When the user pulls on the handle 37 of the lever 33, the drive member 20 is raised by the lifting mechanism 30; when the driving geartrain 21 of the member 20 comes into contact with the rewinding control member 13 of the clock, and more specifically with the rewinding control geartrain 14, the geartrain 21 causes the geartrain 14 and the clock to pivot into the rewinding position in which the axis of the geartrain 21 and the axis of the geartrain 14 of the clock are aligned. Mechanical coupling between the geartrain 21 and the geartrain 14 is at a maximum, and the clock rests on the geartrain 21 such that the gimbal mounting is relieved of the weight of the clock. The clock is thus immobilized on the coupling means 20, for example so that it can be transported or rewound.

Moreover, because the connecting geartrain 22*a* is in mesh with the driving geartrain 43*a*, the geartrain 21 is in mesh with the coupling geartrain 43*a* which means that turning a key at the free end 41*a* of the spindle 41 causes the coupling geartrain 43*a* to rotate and this in turn drives the rotation of the connecting geartrain 22*a*, the retaining spindle 22 and the driving geartrain 21. In turn, the driving geartrain 21 drives the rotation of the rewinding control member 13 through mechanical coupling, making it possible to rewind the barrel of the clock.

In the example which has just been described a scissors-type mechanism is used to raise and lower the drive means 20, but it must be clearly understood that in alternative forms, other types of lifting mechanism can be envisaged; by way of example, provision could be made for a mechanism of the simple knee-joint type or with two links, or even a mechanism of the knee-press type or even a system involving jacks, for example telescopic or non-telescopic screw jacks. Such mechanisms are notably described on pages 144 and 145 of the work entitled "Des Mécanismes Elémentaires [Elementary Mechanisms]" published by Decoopman, ISBN No. 97823650027 which are incorporated herein by reference.

LIST OF PARTS

1 Support
10 Clock
B Barrel
Ba Barrel rewinding geartrain
11 Case
11*a* Bearing
11*b* Seals
12 Mounting
13 Rewinding control member
14 Rewinding control member geartrain
14*a* Flange
14*b* Teeth of the control member geartrain
15 Through-spindle
20 Coupling means
21 Coupling geartrain
21*b* Teeth of the coupling geartrain
21*a* Flange
22 Retaining spindle
22*a* Connecting geartrain
30 Lifting mechanism
33 Lever
34, 35 Links of a pair of links forming scissors
35*a* Mechanical connection between two links 35
37 Handle of lever 33
38 Short side of lever
36*a*, 36*b* Ends forming end stops
40 Mechanism for rotationally driving the coupling means 20
41 Motion-application spindle
41*a* Free end of 41
43 Drive member
43*a* Geartrain
43*b* Claw-coupling pinion
45 Disengagement pinion
46 Elastic return means

What is claimed is:

1. A marine chronometer, comprising:

a clock mounted on a support so that the clock is configured to be inclined with respect to the support by means of a gimbal mounting, the clock comprising, inside a case, a mechanical clock movement driven by a barrel, the clock also comprising a rewinding control member engaged with a rewinding geartrain for rewinding the barrel, wherein the rewinding control member comprises a rewinding control geartrain positioned on the outside of the clock, secured to a spindle passing through a wall of the case via a bearing, the spindle being engaged with the rewinding geartrain, and wherein the chronometer further comprises a coupling means comprising a coupling geartrain, the coupling means configured to move between:

a coupling position where the rewinding control member of the clock is mechanically coupled to the coupling means, and a rest position where the rewinding control member is independent of the coupling means.

2. The chronometer according to claim 1, wherein the bearing comprises, on an interior wall, at least one groove in which a seal is housed.

3. The chronometer according to claim 1, wherein:

the rewinding control geartrain comprises a flange and a plurality of teeth cut into an underside face of the flange of the rewinding control geartrain, and the coupling geartrain comprises a flange and a plurality of teeth cut into a top face of the coupling geartrain flange and arranged in such a way that the coupling geartrain is configured to drive rotation of the rewinding control geartrain when the coupling means is in the coupling position.

4. The chronometer according to claim 1, wherein the coupling means further comprises a retaining spindle and a lifting mechanism for sliding the coupling geartrain along the retaining spindle between the coupling position and the rest position.

5. The chronometer according to claim 1, wherein the rewinding control member and the coupling means are positioned under the case in such a way that, when the coupling means is in the coupling position, the clock is resting on the coupling means.

6. The chronometer according to claim 1, further comprising a rewinding means comprising a rotation mechanism for driving rotation of the coupling means.

7. The chronometer according to claim 6, wherein the rewinding means also comprises a release mechanism configured to isolate the coupling means from the rotation mechanism when the barrel has reached a rewound position.

8. The chronometer according to claim 7, wherein the coupling means comprises a connecting geartrain, the rotation mechanism comprises:

a starting spindle comprising a free end configured to accept a manual drive device including one of a key, a crank, a crown, or an electrically assisted drive device, a drive member comprising a geartrain in mesh with the connecting geartrain and a claw-coupling pinion, the coupling means being mounted and configured to rotate on the starting spindle, and a drive pinion that complements the claw-coupling pinion and is kept in mesh with the claw-coupling pinion by an elastic return means, and the claw-coupling pinion, the drive pinion, and the elastic return means together form the release mechanism of the rewinding means.

9. The chronometer according to claim 1, wherein sealing conditions of the bearing are the same in the rest position and the coupling position.

10. The chronometer according to claim 4, wherein the lifting mechanism includes a lever configured to be manually actuated to drive the coupling geartrain between the rest position and the coupling position.

* * * * *